US006875333B2

(12) United States Patent
Sakaki

(10) Patent No.: US 6,875,333 B2
(45) Date of Patent: Apr. 5, 2005

(54) PLATING APPARATUS FOR WAFER

(75) Inventor: Yasuhiko Sakaki, Hiratsuka (JP)

(73) Assignee: Electroplating Engineers of Japan Limited, Tokyo (JP)

( * ) Notice: Subject to any disclaimer, the term of this patent is extended or adjusted under 35 U.S.C. 154(b) by 84 days.

(21) Appl. No.: 10/366,302

(22) Filed: Feb. 13, 2003

(65) Prior Publication Data

US 2003/0153185 A1 Aug. 14, 2003

(30) Foreign Application Priority Data

Feb. 14, 2002 (JP) ..... P2002-037212

(51) Int. Cl.[7] ..... C25D 5/20; C25D 17/00
(52) U.S. Cl. ..... 205/148; 204/273; 118/400
(58) Field of Search ..... 205/148, 96; 204/224 R, 204/222, 273, DIG. 7; 118/400, 429, 421, 612

(56) References Cited

U.S. PATENT DOCUMENTS 4,102,756 A * 7/1978 Castellani et al. ..... 205/82
6,251,250 B1 * 6/2001 Keigler ..... 205/89
6,322,689 B1 * 11/2001 Omasa ..... 205/324

FOREIGN PATENT DOCUMENTS

| | | | |
|---|---|---|---|
| JP | 11-092947 | A | 4/1999 |
| JP | 11-163015 | A | 6/1999 |
| JP | 2002-115096 | A | 4/2002 |
| JP | 2002-129384 | A | 5/2002 |
| JP | 2002-020890 | A | 7/2002 |
| JP | 2001-064795 | A | 3/2004 |

* cited by examiner

*Primary Examiner*—Donald R. Valentine
(74) *Attorney, Agent, or Firm*—Roberts & Roberts, L.L.P.

(57) ABSTRACT

A plating apparatus is provided to allow the whole area of a target plating surface of a wafer to be subjected to more uniform plating treatment and moreover enables a target plating surface of a wider area to be subjected to positive and uniform plating treatment. In the plating apparatus which has a stirring bar within a plating tank and which performs plating treatment of a target plating surface of the wafer while stirring a plating solution near the target plating surface of the wafer by moving the stirring bar, the stirring bar is rotated while being oscillated in a motion plane substantially parallel to the target plating surface of the wafer. By this operation, the occurrence of an eddy flow of the plating solution is suppressed during stirring and it becomes possible to positively carry out more uniform plating treatment of a wider region.

20 Claims, 7 Drawing Sheets

PLATING APPARATUS FOR WAFER

BACKGROUND OF THE INVENTION

1. Field of the Invention

The present invention relates to a plating apparatus of semiconductor wafer and, more particularly, to a plating apparatus of semiconductor wafer comprising stirring means for a plating solution within a plating tank.

2. Description of the Related Art

As a type of plating apparatus of semiconductor wafer there is available what is called a cup type plating apparatus. The cup type plating apparatus comprises a plating tank, which has an opening in its top part, and a wafer support portion provided along the opening. And the plating tank comprises a solution supply pipe connected to the bottom of the tank as means for circulating a plating solution and a solution discharge passage formed on a side surface of the plating tank in a position near the top opening. The plating solution is supplied from the solution supply pipe to the interior of the plating tank and discharged from the solution discharge passage to outside the plating tank. In performing plating, with a target plating surface of a wafer directed toward the interior of the plating tank, the wafer is placed on the wafer support portion. And in this condition, plating is performed by bringing the plating solution supplied to the interior of the plating tank into contact with the target plating surface of the wafer.

In such a cup type plating apparatus as described above, various improvements have been made in order to realize higher-quality plating treatment. For example, there is a cup type plating apparatus provided with stirring means within a plating tank in order to ensure more uniform plating treatment of a peripheral portion of a target plating surface (refer to the Japanese Patent Laid-Open No. 2001-64795). This stirring means is provided in order to prevent the stagnation of a plating solution in a corner portion formed between the peripheral region of the target plating surface of a wafer and a solution discharge passage located below the peripheral region. That is, when the stirring means is operated, the plating solution is stirred and the stagnation of the plating solution in the corner portion is prevented. When the stagnation is prevented, the peripheral region of the target plating surface adjacent to the corner portion is subjected to more uniform plating treatment.

Incidentally, these days in the fabrication and treatment of wafers, it has been a frequent practice that the wafer surface is subjected to very fine interconnect fabrication. In association with this, it has been necessary to use a technique which allows more uniform plating treatment to be performed on the whole area of a wafer surface having micro-interconnections. For example, such a plating treatment technique as described above is required in the plating treatment for filling the gaps present between the micro-interconnections on the wafer surface.

However, the stirring means of the above-described conventional cup type plating apparatus is used exclusively to improve the plating treatment condition of the peripheral region of a target plating surface, and not to improve the plating treatment of the whole area of a target plating surface.

Furthermore, in recent years, with the progress in the wafer fabrication technology, wafers to be plated themselves have been upsized. And in association with this, the area of a target plating surface has become wider than before.

Accordingly, there is a growing need for a technique which enables the plating treatment of the whole area of a wider target plating surface to be more positively and uniformly carried out.

The present invention was made in view of such problems as described above, and it is the object of the invention to provide a plating apparatus which enables the whole area of a target plating surface of a wafer to be subjected to more uniform plating treatment and moreover enables a target plating surface of a wider area to be subjected to positive and uniform plating treatment.

SUMMARY OF THE INVENTION

Figure 1:
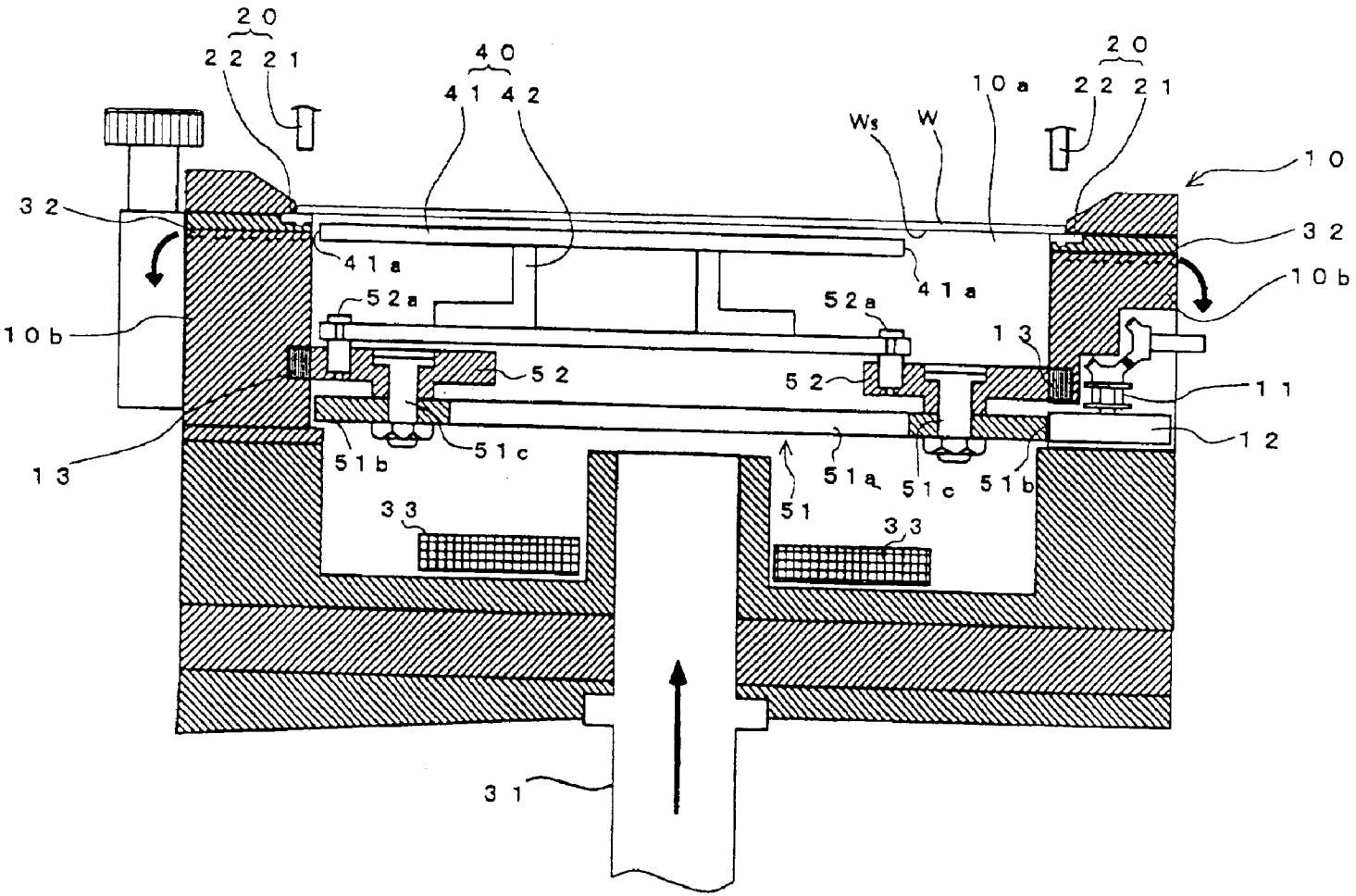
FIG. 1 is a sectional view showing a plating tank of a plating apparatus of the first embodiment.

In order to solve the above-described problems, the structures of conventional stirring means provided in plating apparatuses of wafer were examined more concretely. For example, the conventional stirring means described above is a rotating toroidal disk to which a plurality of impellers are attached. And as described above, with this stirring means it is difficult to uniformly stir the whole region of plating solution. As a result of a close examination of this point, it became apparent that it might be thought that with this stirring means, an eddy flow considered to be caused by the rotational movement of the stirring means occurs in the center region of the plating tank and that the center portion of a target plating surface cannot be sufficiently stirred due to this eddy flow, resulting in a variation in the stirring condition. When there is a variation in the stirring condition, the plating condition is apt to become nonuniform.

On the basis of this result of the examination, further examinations were added as to the motion of the stirring means. As a result, the present inventors have made the following invention.

In the present invention there is provided a plating apparatus for wafer, which comprises a plating tank that houses a plating solution, holding means which positions a wafer to be plated with respect to the plating tank, and a bar-like stirrer provided within the plating tank, and which performs plating treatment of a target plating surface of the wafer while stirring a plating solution near the target plating surface of the wafer by moving the stirrer, in which plating apparatus for wafer, the stirrer is rotated while being oscillated in a motion plane substantially parallel to the target plating surface of the wafer.

In the invention, the oscillation of the stirrer refers to a reciprocating motion in a prescribed motion plane, a motion of repeating a rotational movement in one direction within a prescribed rotational angle and a rotational movement in a direction reverse to this direction, and the like. To give concrete examples, the oscillation of the stirrer refers to, for instance, a reciprocating movement of a body which reciprocally moves on a rail along the rail, a movement like that of the pendulum of a metronome (a swing of the pendulum), a motion of a wiper installed on the surface of a front panel of a vehicle, etc., and a motion of the driving axle of a steam locomotive (a locomotion movement). And the "rotation" in the above-described motion of the stirrer which "is rotated while being oscillated" means to rotate the rail on which a body reciprocally moves and a thing corresponding to the front panel surface on which a wiper moves which were enumerated above as concrete examples, i.e., a support structure of the stirrer (an oscillation space and an oscillation surface of the stirrer).

And when the support structure of a stirrer is rotated while the stirrer is being oscillated, the stirrer performs a more complicated motion compared to a case where the stirrer is rotated. In the case of a rotation only, because the movement of the stirrer is monotonous, a flow in a definite direction is generated in the plating solution within the plating tank and an eddy flow is apt to occur. However, when oscillation and rotation are combined together, the stirrer moves in a complicated manner, thereby suppressing the occurrence of an eddy flow. This enables the whole area of a target plating surface of a wafer to be subjected to more uniform plating treatment and moreover enables a target plating surface of a wider area to be subjected to positive and uniform plating treatment.

A desirable oscillation of the stirrer is, for example, a motion in which the stirrer repeatedly crosses a perpendicular line which is extended from a center position of the target plating surface in a direction orthogonal to the target plating surface (hereinafter also referred to as a crossing motion).

When the stirrer is caused to perform such a crossing motion as described above, it is possible to positively stir by use of the stirrer a plating solution region which could not be easily stirred by conventional stirring means, i.e., a plating solution region corresponding to the center position of the target plating surface, with the result that the occurrence of an eddy flow in this plating solution region is more positively suppressed. Therefore, by using a plating apparatus of the invention, the whole region of the plating solution corresponding to the target plating surface is more positively and uniformly stirred. When the whole region of the plating solution is uniformly stirred, the supply of plating ions, the current density distribution, etc. become uniform and the whole area of the target plating surface is subjected to more uniform plating treatment. And even when the area of a target plating surface is wider, it becomes possible to ensure that the whole area of the target plating surface is positively subjected to uniform plating treatment.

Incidentally, it might be thought that the reason why conventionally it has been difficult to uniformly stir the whole region of the plating solution is, for example, as follows. A plating tank usually has a substantially cylindrical shape and the plating solution region corresponding to the center position of a target plating surface corresponds to the center region of the plating tank where an eddy flow is apt to occur. And in order to stir as wide a region as possible, it is necessary to install a large-sized stirrer. When a stirring device is of a type in which the stirrer performs only a rotational motion, it is inevitable that the rotational axis of the stirrer will be installed in the center region of the plating tank. As a result, the motion of the stirrer in a plating solution region near the rotational axis become small and monotonous and it might be thought that the stirring in this plating solution region becomes insufficient.

Furthermore, a concrete support structure of the stirrer was examined. As a result, it became apparent that it is preferred that the plating apparatus for wafer further comprise, as the support structure of the stirrer, a pedestal which rotates about an orthogonal axis substantially orthogonal to the target plating surface within the plating tank and support means of the stirrer which is installed on the pedestal, and that the support means have a set of connecting members which constitute a quadric link mechanism along with the pedestal and the stirrer.

The set of connecting members of the support means comprises two connecting members which constitute the quadric link mechanism connected to the stirrer and the pedestal. Mechanisms, such as a parallel link mechanism in which two members which are opposed to each other have the same length, a cross link mechanism, a crank lever mechanism, a crank slider mechanism or a double crank mechanism can be enumerated as the quadric link mechanism. Incidentally, it is not necessary that each connecting member be a rod-like member, and a rotating disk, a gear, etc. may be used so long as they function similarly. As described above, there are various types of quadric link mechanism. In this case, however, an investigation is made into a case where the support structure of the stirrer is a parallel link mechanism in which the stirrer is supported by two connecting members of equal length which are connected to the pedestal.

In this case, if a pair of connecting members is rotated with respect to the pedestal, with the motion of the pedestal kept in a stopped condition, then the stirrer performs a motion while keeping a posture parallel to the posture (direction) at the start of the motion (hereinafter also referred to as a parallel motion). And it follows that during a parallel motion, the bar-like stirring member repeats an oscillation in a longitudinal direction and in a direction intersecting at right angles to the longitudinal direction (a transverse direction) with an oscillation amplitude corresponding to twice the length of the connecting members. And this motion of the stirrer is a motion in which the stirrer repeatedly crosses a perpendicular line which is extended from a center position of the target plating surface in a direction orthogonal to the target plating surface (a crossing motion).

When the stirrer is thus caused to so oscillate as to perform a cross motion, a plating solution region corresponding to the center position of the target plating surface is positively stirred by the stirrer. And the whole area of the target plating surface is subjected to more uniform plating treatment. Furthermore, it becomes possible to ensure that a target plating surface of a wider area can be positively subjected to uniform plating treatment.

And an investigation was made into uniformly stirring the whole region of the plating solution corresponding to the whole area of a target plating surface from the viewpoint of a concrete size of the stirrer. As a result, it became apparent that it is preferred that the bar-like stirrer have a longitudinal size longer than a radius size of the plating tank. This is because when the stirrer has a size like this, the stirrer positively performs a cross motion during the rotation of the stirrer at the same time with its oscillation in the plating tank, with the result that the whole region of the plating solution corresponding to the whole area of a target plating surface can be uniformly stirred.

Moreover, an investigation was made into a drive mechanism which transmits power to the stirring means. As will be understood from the foregoing descriptions, the stirring means is installed within the plating tank. Therefore, when the stirring means is operated by use of a power source such as a motor installed outside the plating tank, it is necessary to make liquid-tight the drive mechanism which transmits a driving force. As a result of the investigation, it became apparent that as the drive mechanism which rotates the pedestal of the stirrer, it is preferable to use a device which has a magnet coupling and transmits a driving force from the power source to the pedestal via the magnet coupling. A magnet coupling comprises a driving side rotor to which parts on the power source side are connected, a driven side rotor to which parts on the pedestal side are connected and a partition wall disposed between the two rotors, and the space in which the driving side rotor is installed and the space in which the driven side rotor is installed are completely separated by the partition wall. Therefore, even if a plating solution enters the driven side, this plating solution will not leak to the driving side. If such a coupling as described above is used, it is possible to positively transmit rotations from the driving side to the driven side as in the case of use of an ordinary coupling while preventing the leakage of the plating solution from the parts of the drive mechanism to outside the plating tank. Incidentally, the partition wall is made of a nonmagnetic material such as synthetic resins, for example, FRP and engineering plastics.

Also, an investigation was made into a case where the plating apparatus in which the stirrer stirring a plating solution near a target plating surface of a wafer is provided with what is called a diaphragm in the plating tank. As a result, it became apparent that in a case where holding means for a wafer is provided with a cathode used in electrolytic plating treatment, an anode used in electrolytic plating treatment is provided within the plating tank and, furthermore, within the plating tank there is provided a diaphragm which partitions an interior of the plating tank into a cathode side on which the stirrer is installed and an anode side, it is preferred that stirring means other than the stirrer be installed in a region on the anode side of the interior of the plating tank partitioned by the diaphragm. The stirring means is used to stir a region near a target plating surface of a wafer brought into contact with the cathode and is installed in a region on the cathode side within the plating tank. Therefore, when a diaphragm which partitions the interior of the plating tank into a cathode side and an anode side is installed, it is impossible to stir the anode side even when a stirrer which stirs a plating solution near a target plating area of a wafer is installed. In such a case, if stirring means other than the stirrer installed on the cathode side is installed in a region on the anode side within the plating tank, the plating solution on the anode side can be stirred and the whole area within the plating tank can be stirred. If the whole area within the plating tank can be stirred, it is possible to more positively ensure the supply of plating ions and a uniform condition of the current density distribution.

Incidentally, the support structure of the stirrer of the plating apparatus for wafer is not limited to the above-described structure comprising a pedestal and support means.

For example, in a plating apparatus for wafer, which comprises a plating tank that houses a plating solution, holding means which positions a wafer to be plated with respect to the plating tank, and a bar-like stirrer provided within the plating tank, and which performs plating treatment of a target plating surface of the wafer while stirring a plating solution near the target plating surface of the wafer by rotating the stirrer, it is necessary only that the stirrer rotate in a motion plane substantially parallel to the target plating surface of the wafer and make a movement in such a manner that a locus of a center position of rotation of the stirrer is formed outside a center position of the stirrer and the stirrer repeatedly crosses a perpendicular line which is extended from a center position of the target plating surface in a direction orthogonal to the target plating surface.

The reason why a good result is obtained when the stirrer is moved like this is that the occurrence of an eddy flow is suppressed by moving the position of rotational center of the stirrer. Although when the stirrer is rotated, generally a rotating flow (an eddy flow) of the plating solution around the rotational center occurs, it might be thought that when the position of rotational center is moved, the occurrence of an eddy flow in a definite position is prevented. However, even when the stirrer (the position of rotational center of the stirrer) is moved, an eddy flow is apt to occur in the center position of the plating tank if this movement is such that the stirrer rotates around the center position of the plating tank. This point was further examined and as a result, it became apparent that it is preferred that the stirrer be rotated in such a manner that a locus of the position of rotational center of the stirrer is formed outside a locus of the center position of the stirrer. When the stirrer is moved like this, a rotating flow around the center position of the plating tank does not occur and the occurrence of an eddy flow is positively suppressed. And when the stirrer is moved like this, it is possible to constantly keep the position of rotational center of the stirrer away form the center position of the plating tank. If this is possible, the occurrence of an eddy flow in a center region of the plating tank is positively suppressed. Also, the longer the distance of the position of rotational center of the stirrer from the center region of the plating tank, the easier it is to make the moving speed of the stirrer in the center region relatively fast when the stirrer crosses the center region. Therefore, it becomes possible to more positively stir the plating solution region corresponding to the center position of a target plating surface by means of the stirrer. As a result, it becomes possible to ensure that the whole area of a target plating surface is subjected to more uniform plating treatment. Furthermore, it becomes possible to ensure that a target plating surface of larger area is positively subjected to uniform plating treatment.

And the reason why it is preferred that the stirrer be moved in such a manner that the stirrer repeatedly crosses a perpendicular line which is extended from an intermediate position of the target plating surface in a direction orthogonal to the target plating surface, is as described above. When the stirrer is moved like this, the whole area of the plating solution corresponding to a target plating surface is more positively uniformly stirred.

As a concrete structure which moves the stirrer like this it is possible to refer to, for example, a structure which supports the stirrer by use of the above-described quadric link mechanism. That is, the support structure of the stirrer is such that a pedestal which rotates about an orthogonal axis substantially orthogonal to the target plating surface is provided within the plating tank and on this pedestal is further provided support means which has a set of connecting members which connect the stirrer and the pedestal together thereby to constitute a quadric link mechanism by connecting the stirrer, the pedestal and the set of connecting members.

Incidentally, even in the case where the stirrer is moved in such a manner that a locus of the position of rotational center of the stirrer is formed outside a locus of a center position of the stirrer, it is preferred that the longitudinal size of the bar-like stirrer be larger than the radial size of the plating tank. When the stirring means has a size like this, it follows that when the stirrer is moved, the stirrer positively cross a perpendicular line which is extended from a center position of the target plating surface in a direction orthogonal to the target plating surface. Therefore, the plating solution region corresponding to the center position of a target plating surface can be positively stirred by the stirrer, whereby the whole plating liquid region corresponding to the whole area of a target plating surface can be uniformly and positively stirred.

DETAILED DESCRIPTION OF THE PREFERRED EMBODIMENTS

Preferred embodiments of a plating apparatus for wafer related to the present invention will be described below by referring to the drawings.

Figure 2:
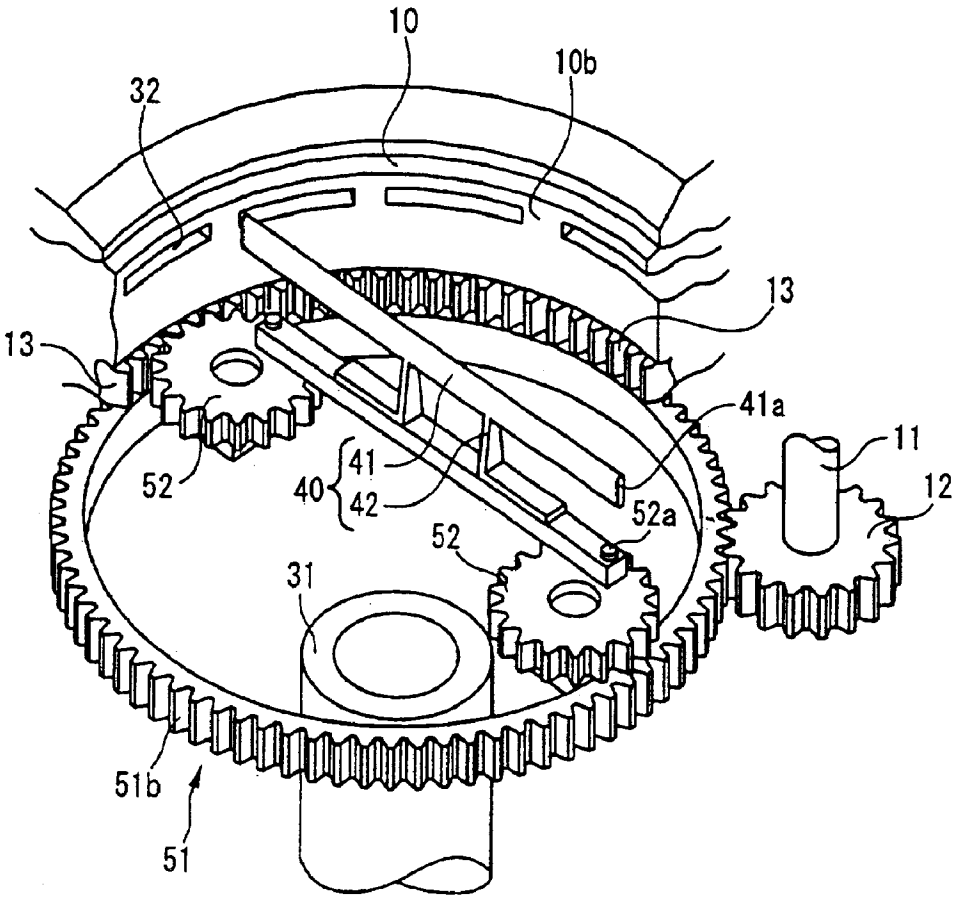
FIG. 2 is a partial perspective view of a stirring mechanism.
Figure 3:
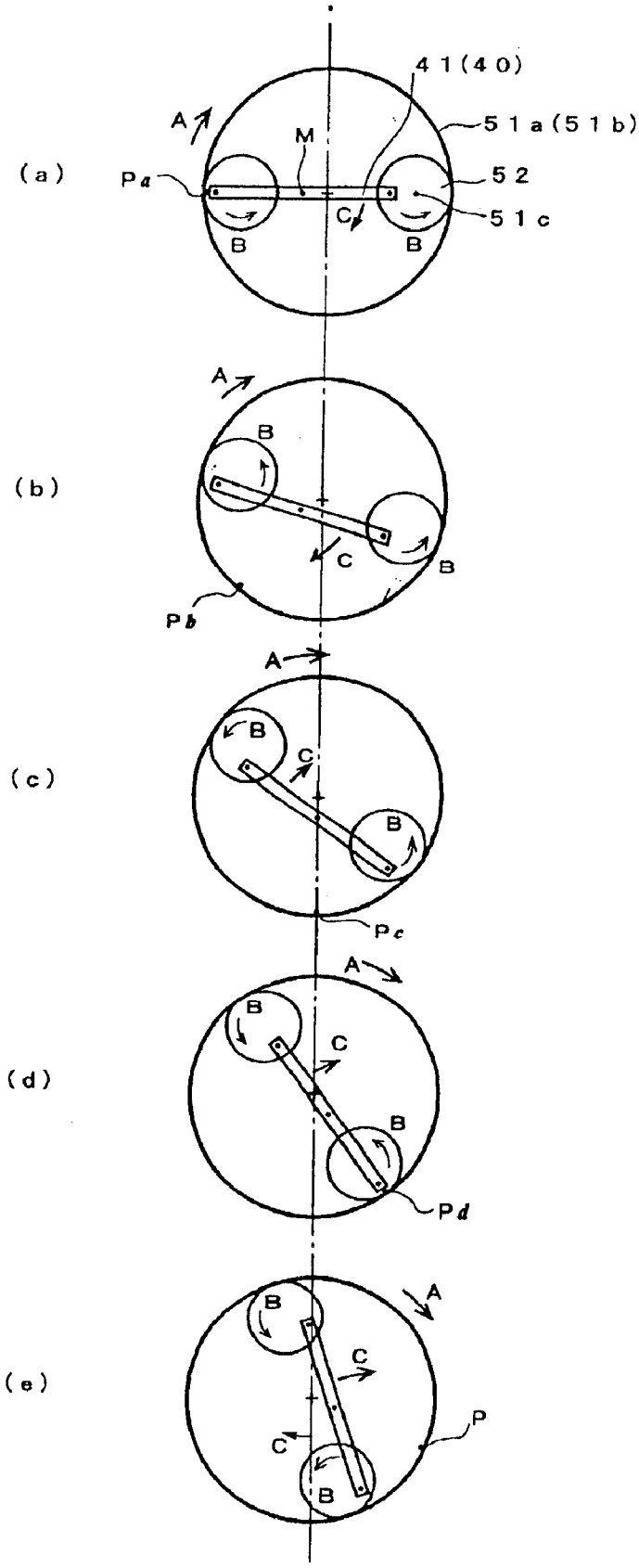
FIGS. 3(*a*) to 3(E) are explanatory illustrations of the motions of a stirrer.

First Embodiment:

The plating apparatus for wafer shown in FIGS. 1 and 2 is a cup type plating apparatus. This plating apparatus is provided with a plating tank 10 which houses a plating solution, and the plating tank 10 has in its top portion an opening 10*a* on which a wafer W to be plated is placed. And a holding member (holding means) 20 which holds the wafer W is attached to the end edges of this opening 10*a*. Schematically, this holding member 20 is constituted by a seal packing 21 to prevent the leakage of the plating solution, a cathode electrode (a cathode) disposed on the packing 21, which is not shown, and a holder member 22 which holds the outer peripheral portion of the wafer W placed on the packing 21 from above along the whole circumference.

A supply pipe 31 for plating solution is connected to the bottom of the plating tank 10, and a discharge passage 32 of plating solution is formed above a side wall 10*b* of the plating tank 10, i.e., in a position adjoining to the holding member 20. The plating solution supplied from the supply pipe 31 to the interior of the plating tank 10 flows first upward to the wafer W and then near a target plating surface Ws of the wafer W from the center portion of the wafer W toward the peripheral portion, and is discharged thereafter from the plating tank 10 through the discharge passage 32. As shown in the drawing, an anode electrode (an anode) 33 for the cathode electrode is provided within the plating tank 10. For example, metal particles which supply metal ions (for example, copper ions in the case of copper plating) are used as the anode electrode 33. The appearance of a container of the anode electrode 33 is such that the container is in the form of a disk having a hole in the center portion, and the container is installed in a condition inserted by the supply pipe 31 from the outside.

Furthermore, a stirrer 40 used for stirring the plating solution is movably provided within the plating tank 10. This stirrer 40 is supported by a pedestal 51 which is installed within the plating tank 10 so as to be rotatable on a vertical axis.

The pedestal 51 has a pedestal body 51*a*, and a ring-shaped external gear 51*b* is provided on the outer periphery of the pedestal body 51*b*. This external gear 51*b* is rotated by receiving power from a drive mechanism installed in the plating tank 10. Incidentally, the drive mechanism has a driving shaft 11 rotated by a motor (a driving source), which is not shown, and a driving gear 12 attached to this driving shaft 11, and the external gear 51*b* meshes with this driving gear 12.

A pair of driven gears (connecting members) 52, 52 consisting of spur gears is provided on the pedestal 51. Each driven gear 52 is rotatably supported by a support shaft 51*c* attached to a peripheral part of the pedestal body 51*a* and meshes with an annular internal gear 13 provided on the side wall 10*b* of the plating tank 10. The stirrer 40 is attached on the driven gear 52 which is installed in this condition.

To give a further detailed description, the stirrer 40 has a bar-like portion 41, which is horizontal, i.e., which extends parallel to the target plating surface Ws of the wafer W, and a leg portion 42 for fixing this bar-like portion 41 to the driven gear 52. This bar-like portion 41 is disposed adjacent to the target plating surface Ws of the wafer W placed on the seal packing 21. Therefore, a plating solution region corresponding to the target plating surface Ws (near the target plating surface) is stirred by causing the bar-like portion 41 to move. Incidentally, the motion of the bar-like portion will be described later. Each end of the leg portion 42 is rotatably connected to its corresponding driven gear 52. A connection position 52*a* between the leg portion 42 and the driven gear 52 is in a position shifted from a support shaft 51*c*. Therefore, when the driven gear 52 rotates, the connection point 52*a* of the leg portion 42 performs a rotational motion accordingly. Incidentally, the bar-like portion 41 of this embodiment does not move up and down, instead moves only in a direction parallel to the target plating surface Ws (in a motion plane parallel to the target plating surface Ws).

The operation of the stirrer 40 (bar-like portion 41) of the stirring means thus configured will be described with reference to FIGS. 3(A) to 3(E). Schematic motions of the stirrer 40 are shown in a time-series manner in FIGS. 3(A) to 3(E).

In operating the stirrer 40, the motor is first started. When the motor is started, the driving gear 12 of the driving shaft 11 rotates and the pedestal body 51*a* rotates together with the external gear 51*b* (in the direction indicated by an arrow A in FIGS. 3(A) to 3(E)). As described earlier, since the stirrer 40 is attached to the pedestal 51, the stirrer 40 rotates together with the pedestal body 51*a* when the pedestal body 51*a* rotates. Furthermore, when the pedestal body 51*a* rotates, the driven gear 52 on the pedestal body 51*a* moves along the side wall of the plating tank 10. Because each driven gear 52 meshes with its corresponding internal gear 13, the driven gear 52 rotates about its support axis 51*c* as the driven gear 52 moves along the side wall of the plating tank 10 (in the direction indicated by an arrow B in FIGS. 3(A) to 3(E). When the driven gear 52 rotates, the two ends of the stirrer 40 connected to the driven gear 52 rotate and the stirrer 40 performs a motion with respect to the pedestal body 51*a*. Because the two driven gears 52 have the same specifications, such as the same number of teeth, the stirrer 40 performs a parallel motion on the pedestal body 51*a* as the driven gear 52 rotates. Furthermore, because the parallel motion of the stirrer 40 is generated by a rotational motion, the stirrer 40 performs a reciprocating motion (an oscillation) on the pedestal body 51*a* in both of a longitudinal direction of the bar-like portion 41 and a direction intersecting at right angles to the longitudinal direction (a transverse direction). Thus, it follows that the stirrer 40 performs a composite motion of the rotational motion of the pedestal body and the rotational motion of the driven gear. As a result, the stirrer 40 rotates while oscillating within the plating tank 10. Incidentally, an arrow C in FIGS. 3(A) to 3(E) indicates an apparent motion of the bar-like portion 41 which rotates while oscillating within the plating tank 10.

Also, in FIGS. 3(A) to 3(E) the intermediate position (center position) of the bar-like portion 41 of the stirrer 40 is indicated by the point M and the rotational center (instantaneous center) of the rotating bar-like member 41 is indicated by the points Pa to Pe. As is apparent from the figures, the rotational center of the bar-like portion 41 moves along the inner circumferential surface of the plating tank 10 in this embodiment.

Figure 5:
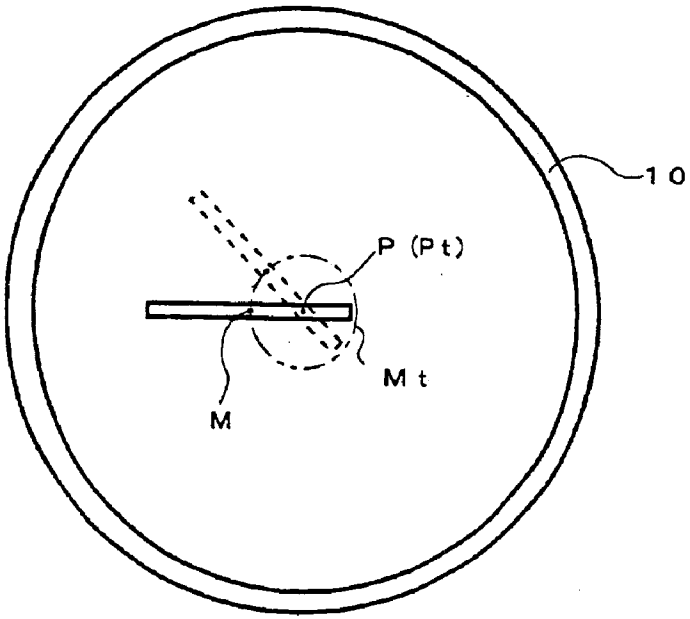
FIG. 5 is an explanatory illustration of the motions of a stirrer of a comparative example.
Figure 4:
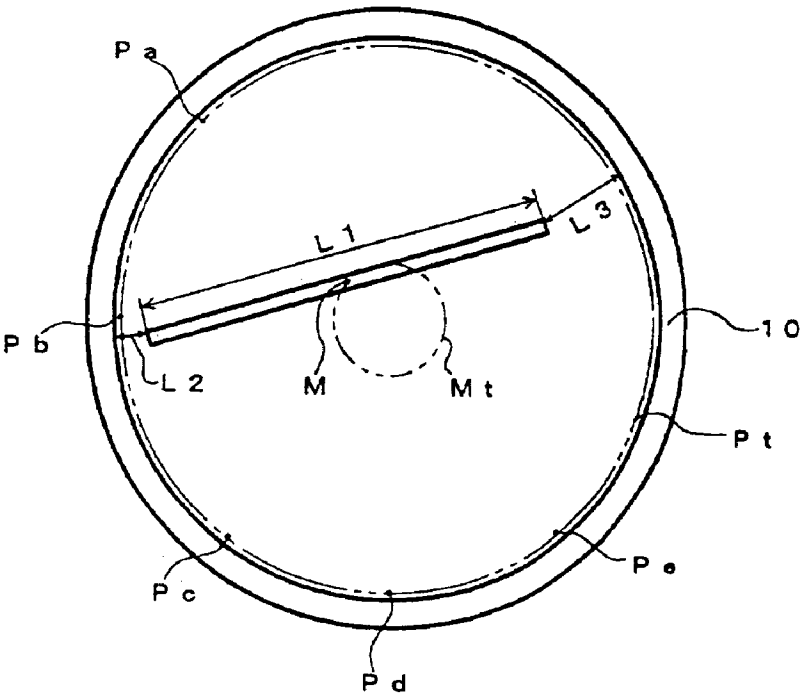
FIG. 4 is an explanatory illustration of the motions of the stirrer.

A locus Pt of the position of rotational center Pa to Pe which moves like this is schematically shown in FIG. 4. Also, a locus Mt of the intermediate position M of the bar-like portion 41 is schematically shown in FIG. 4. As shown in the figure, the stirrer 40 of the plating apparatus of this embodiment moves in such a manner that the locus Pt of the position of rotational center P is formed outside the locus Mt of the intermediate position M. For a comparison with this, in FIG. 5 is shown an example in which the position of rotational center P does not move with respect to the stirrer 40 itself (for example, in a case where a shaft of the stirrer 40 is directly rotatably supported on the pedestal 51). In this example, the locus Mt of the intermediate position M of the stirrer 40 is outside the position of rotational center P.

Because as shown in FIG. 5, when the locus Mt of the intermediate position M is outside the position of rotational center P, the position of rotational center remains in a definite position, a flow of plating solution around the position of rotational center occurs and an eddy flow is easy to occur. In this respect, when the movement of the position of rotational center P is large as in this embodiment shown in FIG. 4, the occurrence of an eddy flow is positively prevented and the whole region corresponding to the whole area of the target plating surface Ws is positively uniformly stirred. On further reflection, when it is ensured that the locus Pt of the position of rotational center P of the stirrer 40 is set outside the locus Mt of the intermediate position M, the movement of the position of rotational center P becomes large, with the result that the whole region of the plating solution corresponding to the target plating surface Ws is uniformly stirred by the stirrer 40 and it becomes possible to perform uniform plating treatment of the whole target plating surface Ws.

Incidentally, the basic motion of the stirrer 40 is as described above. However, the rotative direction of the stirrer 40 may be reversed, for example, by changing the rotative direction of the driving gear 12 during stirring thereby to reverse the rotative direction of the pedestal 51. This ensures that the occurrence of an eddy flow of plating solution within the plating tank 10 is more positively prevented. Furthermore, the whole region of plating solution corresponding to the target plating surface Ws can be more uniformly stirred.

A procedure for plating a wafer by use of a plating apparatus of the above-described construction will be briefly described below.

First, a plating solution is supplied to the interior of the plating tank 10 via the supply pipe 31 and the interior of the plating tank 10 is filled with the plating solution. A wafer W is placed on the packing 21 with the target plating surface Ws of the wafer W facing the opening 10*a* of the plating tank 10, and the wafer W is held by being depressed by use of the holder 22. Then the target plating surface Ws comes into contact with the plating solution. When energization is performed between the two electrode in this state, the target plating surface Ws is subjected to plating treatment. At this time, the stirrer 40 is caused to oscillate in a motion plane parallel to the target plating surface Ws by starting the motor as required, whereby the plating solution in the plating tank 10, more concretely, the plating solution in a region corresponding to the target plating surface Ws is stirred.

Then the stirrer 40 stirs the plating solution while moving in a wide range within the plating tank 10. As a result, for the whole area of the target plating surface Ws of the wafer W the conditions such as the concentration of the plating solution become more uniform and hence it is possible to perform more uniform plating treatment. And also for a target plating surface Ws of wider area than before, it is possible to perform uniform plating treatment.

Incidentally, in the plating apparatus of this embodiment the motion range of the bar-like portion 41 can be adjusted by adjusting the distance from the connection position 52*a* to the support shaft 51*c* (the turning radius of the connection position). In this case, the length of the stirrer 40 is adjusted as required. Also, in this embodiment, an adjustment is made so that as wide a range as possible can be stirred by the stirrer 40 so long as the bar-like portion 41 does not come into contact with the side wall 10*b* of the plating tank 10 by making it large the turning radius of the connection position 52. As a result, the plating solution in a region corresponding to the whole area of the target plating surface Ws can be uniformly stirred and it is possible to perform uniform plating treatment of the whole target plating surface Ws.

The interior of the plating tank 10 of the plating apparatus of this embodiment is in the shape of a circular cylinder and the longitudinal size of the bar-like portion 41 of the stirrer 40 is larger than the radius size of the plating apparatus 10. In this case, when a comparison is made between the longitudinal size of the bar-like portion L1 and a total length of the shortest lengths L2 and L3 from each end 41*a* of the bar-like portion 41 to the inner circumferential surface of the side wall 10*b* of the plating tank 10, the relationship L1>L2+L3 is obtained even when the bar-like portion 41 is moved to any position. That is, the longitudinal size of the bar-like portion 41 is always longer. When a stirrer 40 having such a size is used, the stirrer 40 is sure to perform a motion in which the stirrer 40 crosses immediately under the center position of the target plating surface Ws (a perpendicular line which is extended from a center position of the target plating surface in a direction orthogonal to the target plating surface) (refer to FIGS. 3(A) to 3(E)). Therefore, the plating solution in a region corresponding to the center portion of the target plating surface Ws can be more positively stirred.

Second Embodiment:

Next, a description will be given below of a plating apparatus of the second embodiment in which the drive mechanism which rotates the external gear 51*b* is different from that of the first embodiment. Incidentally, because the basic construction of this plating apparatus is the same as that of the plating apparatus of the first embodiment, its description is omitted.

Figure 6:
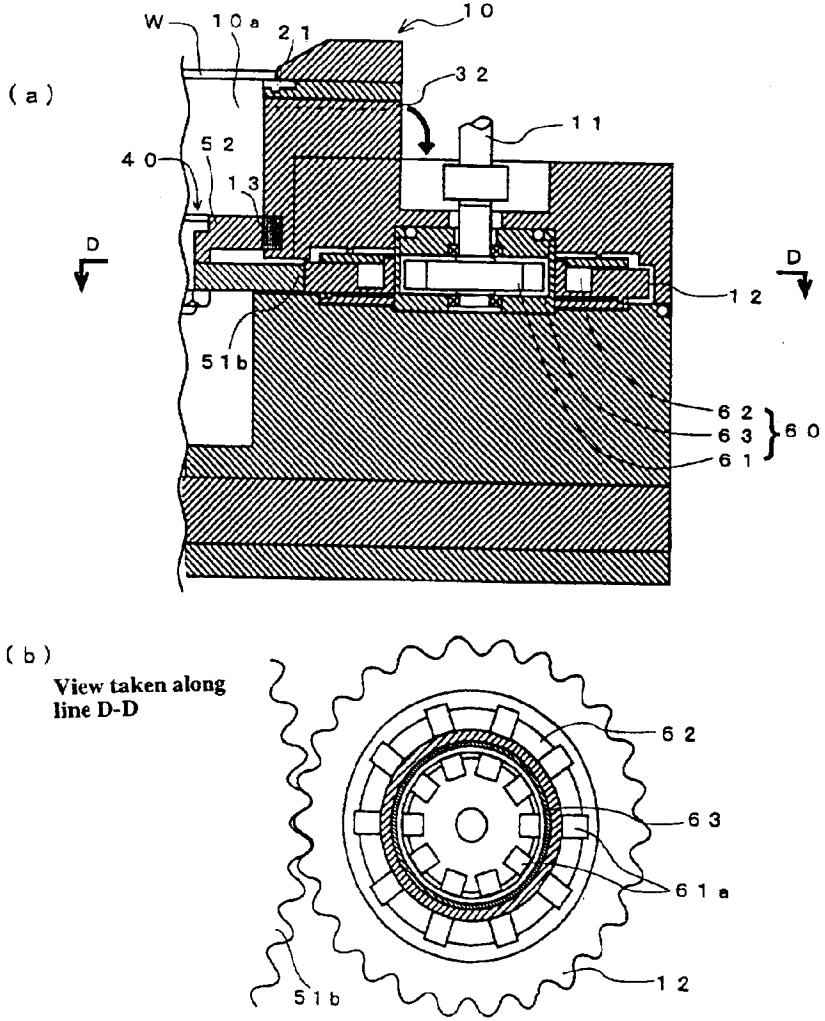
FIGS. 6(A) and 6(B) are enlarged partial view of a plating apparatus of the second embodiment.

As shown in FIGS. 6(A) and 6(B), in this plating apparatus a driving shaft 11 which transmits rotations from a motor, which is not shown, (the driving side) and a driving gear 12 which meshes with an external gear 51*b* (the driven side) are connected together via a magnet coupling 60. Schematically, this magnet coupling 60, which is of a cylinder type, comprises an inner ring 61 to which the driving shaft 11 is connected (a driving side rotor), an outer ring 62 to which the driving shaft 12 is connected (a driven side rotor), and a partition wall 63 disposed between the inner ring 61 and the outer ring 62. The outer peripheral surface of the inner ring 61 and the inner circumferential surface of the outer ring 62 are each provided with a multipolar-magnetized ring-shaped magnet 61*a*, and rotations are transmitted between the inner ring 61 (the driving side) and the outer ring 62 (the driven side), which are installed in a mutually non-contact condition via a partition wall 63, by use of a magnetic force. The partition wall 63 installed between the two rings 61, 62 provides a partition between a space where the inner ring 61 connected to the driving shaft 11 is provided and a space where the outer ring 62 to which the driving gear 12 is attached is provided.

In a plating apparatus having such a drive mechanism as described above, when the driving shaft 11 is rotated by starting a motor which is not shown, the inner ring 61 of the magnet coupling 60 rotates and the outer ring 62 installed outside via the partition wall 63 rotates. When the outer ring 62 rotates, the driving gear 12 attached to this outer ring rotates, the external gear 51*b* rotates and a stirrer 41 on a pedestal 51 to which the external gear 51*b* is attached rotates to stir the plating solution.

By using such a drive mechanism, the entry of the plating solution from the space on the driven side where the outer ring 62 is disposed into the space on the inner ring 61 side (the driving side) is positively prevented by the partition wall 63. That is, the leakage of the plating solution from parts of the drive mechanism is positively prevented by ensuring that the rotations of the motor (the driving side) are transmitted to the external gear 51*b* (the driven side) via the magnet coupling 60.

Third Embodiment:

Next, a further embodiment in which a diaphragm is provided within the plating tank will be described below. Incidentally, because the basic construction of this plating apparatus is the same as that of the plating apparatus of the first embodiment, its description is omitted.

Figure 7:
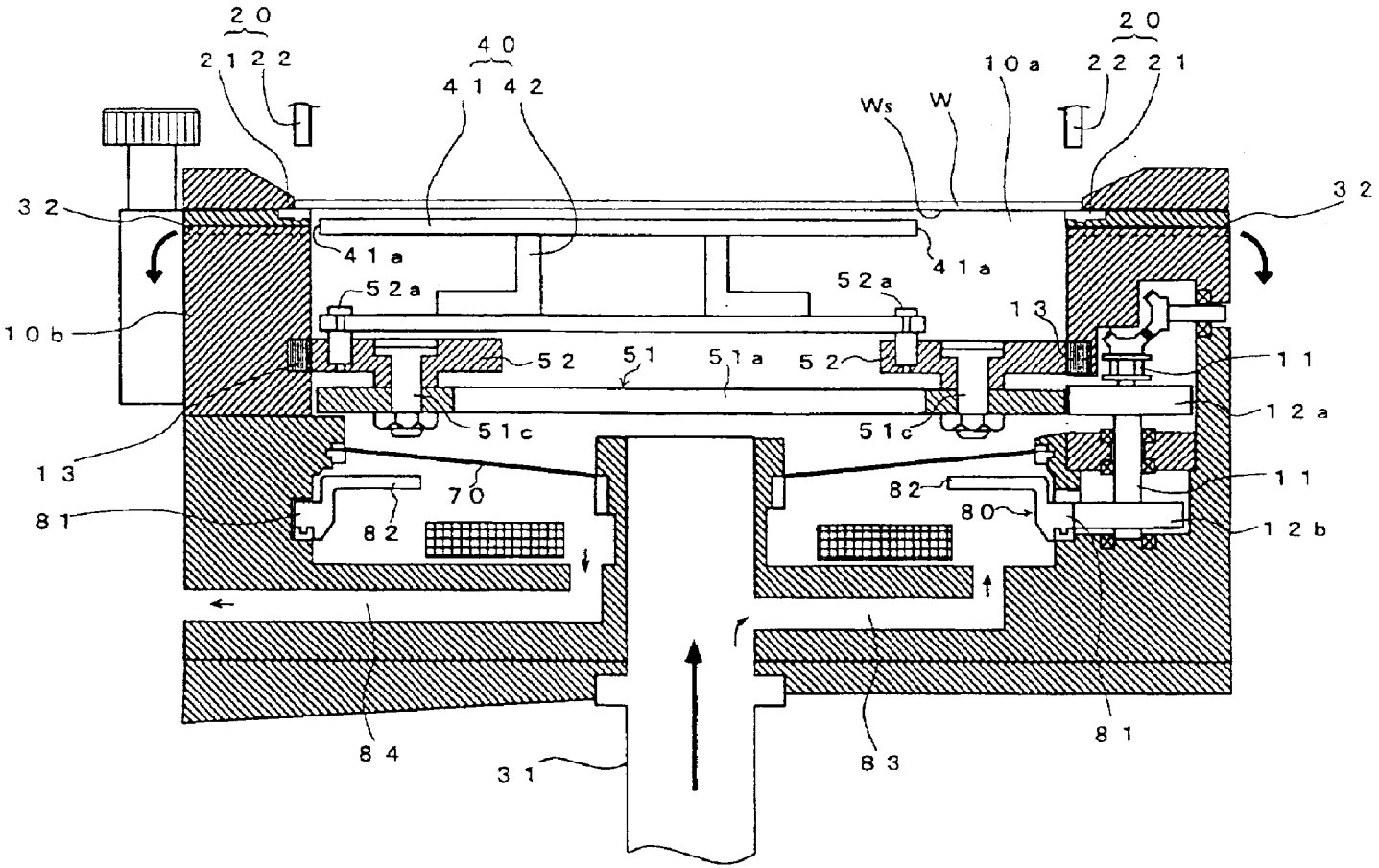
FIG. 7 is an explanatory illustration of a plating tank of a plating apparatus of the third embodiment.

As shown in FIG. 7, the interior of the plating tank 10 of this plating apparatus is provided with a diaphragm 70 which partitions the interior of the plating tank 10 into an upper portion of the interior of the plating tank 10 in which a first stirrer 40 is installed (the cathode electrode side) and a lower portion of the interior of the plating tank 10 in which an anode electrode 33 is installed (the anode electrode side). The diaphragm 70 permits energization between the two electrodes through the plating solution (i.e., has energizing properties) and is made of, for example, woven fabrics of polypropylene filaments, ion exchange membranes including fluoroplastics-containing ion exchange membranes or non-woven fabrics. In electrolytic plating treatment, suspended matter called sludge may sometimes be formed as a result of the melting of the anode electrode. However, when a diaphragm as described above is installed, it is possible to prevent the adhering of sludge etc. to a target plating surface.

A second stirrer (stirring means) 80 other than the first stirrer 40 is installed in a region below the diaphragm 70 within the plating tank 10. This second stirrer 80 has a ring-shaped gear 81 provided with external teeth of the same size of the external teeth of the external gear 51*b* which has already been described. And to this ring-shaped gear 81 are attached a plurality of substantially L-shaped vanes for stirring (four vanes in this embodiment). Furthermore, as shown in the figure, a driving shaft 11 extends downward in comparison with that of the first embodiment and is provided with a first driving shaft 12*a* which meshes with the external gear 51*b* and a second driving gear 12*b* which meshes with the ring-shaped gear. Therefore, when the driving shaft 11 is rotated, the first stirrer 40 and the second stirrer 80 rotate to stir the plating solution.

On the bottom of the plating tank 10 are provided a first solution passage 83 and a second solution passage 84, which are used as circulation means of the plating Solution. The first solution passage 83 provides communication between a supply pipe 31 for plating solution and the region of the plating tank 10 below the diaphragm 70. Therefore, it is possible to supply the plating solution from the supply pipe 31 to the side below the diaphragm 70 within the plating tank 10. On the other hand, the second solution passage 84 provides communication between the region below the diaphragm 70 and a discharge port (not shown) and it is possible to discharge the plating solution by use of the second solution passage 84.

In this plating apparatus, when the plating solution is supplied to the interior of the plating tank 10 by use of the supply pipe 31, the plating solution is supplied to the two regions above and below the diaphragm 70 and the interior of the plating tank 10 is filled with the plating solution. The plating solution supplied to the side above the diaphragm 70 in the plating tank 10 is discharged from a discharge passage 32 formed in a side wall 10*b* of the plating tank 10 to outside the plating tank 10. On the other hand, the plating solution supplied to the side below the diaphragm is discharged from the second solution passage to outside the plating tank 10. Thus, this plating apparatus can circulate the plating solution in the two regions above and below the diaphragm 70. Furthermore, in this plating apparatus, when the motor is started, both of the first stirrer 40 and the second stirrer 80 operate. Because the first stirrer 40 stirs the plating solution in a region corresponding to the target plating surface Ws and the second stirrer 80 stirs the region below the diaphragm 70, the whole area of the interior of the plating tank 10 is stirred when the motor is started. When the whole area of the interior of the plating tank 10 can be stirred, it is possible to keep the supply of plating ions and the current density distribution during plating treatment in a uniform condition, making it possible to obtain better plating. Incidentally, because the procedure for plating treatment is the same as with the plating apparatus of the first embodiment, a detailed description is omitted.

Figure 8:
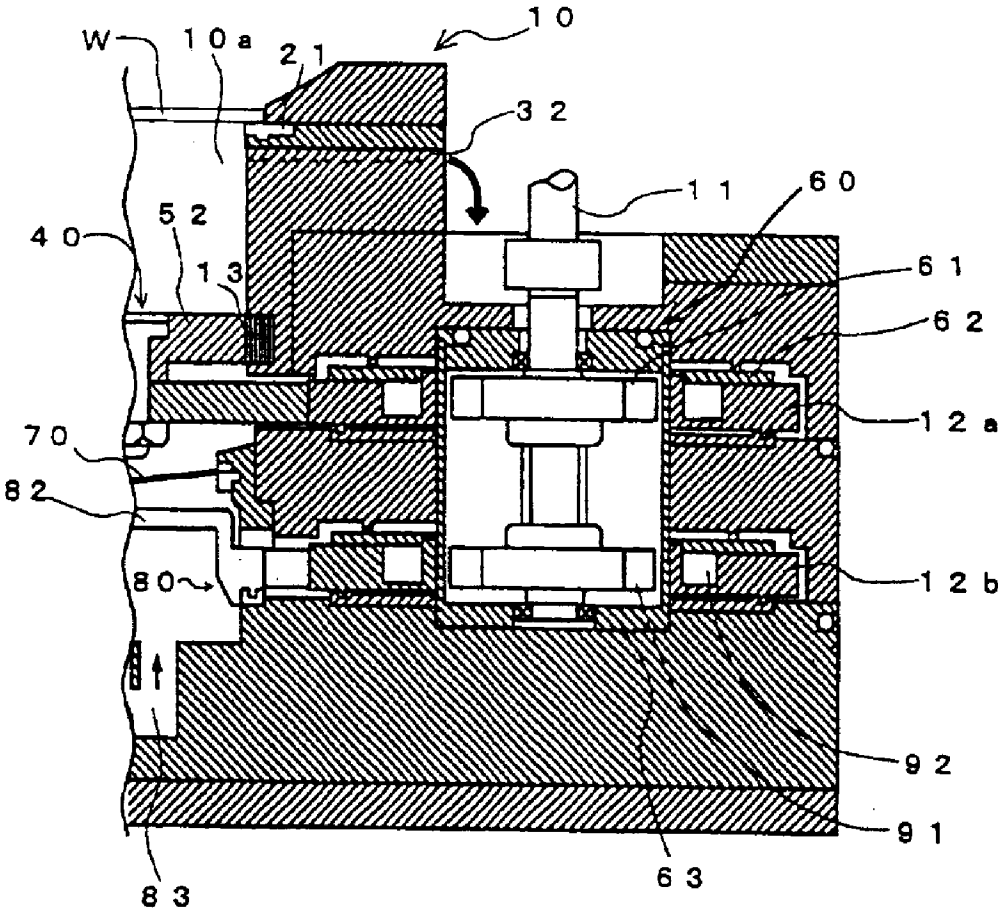
FIG. 8 is an enlarged partial view of the plating tank of the plating apparatus of the third embodiment in which the driving mechanism of the stirrer is of a different mode.

Also, as shown in FIG. 8, by using a mechanism which transmits a driving force from a power source to the first stirrer 40 and second stirrer 80 via a magnet coupling 60 as a drive mechanism which rotates the first stirrer 40 and second stirrer 80, the leakage of the plating solution from the parts of the drive mechanism can be positively and easily prevented as with the plating apparatus of the second embodiment.

The magnet coupling 60 used in the plating apparatus shown in FIG. 8, which is of a cylinder type, has two inner rings on the inner side of partition walls 63, i.e., a first inner ring 61 (a driving side rotor) to rotate a pedestal 51 of the first stirrer 40 and a second inner ring 91 (a driving side rotor) to rotate the second stirrer 80 on the side below the diaphragm 70 and has two outer rings 62 and 92, to which driving shafts 12*a* and 12*b* are connected, corresponding respectively to the inner rings 61 and 91 on the outer side of the partition walls 63. Both of the inner rings 61 and 91 are each attached to a driving shaft 11, and when the driving shaft 11 is rotated, the two inner rings 61 and 91 rotate and the first stirrer 40 and second stirrer 80 rotate. Incidentally, although the partition wall is divided into two upper and lower members in this embodiment, the partition wall may be constructed as one piece. Also, the construction of parts other than the coupling 60 of the plating apparatus shown in FIG. 8 are the same as with the plating apparatus of the third embodiment and their descriptions are omitted.

As will be understood from the above descriptions, the present invention can be used as a plating apparatus of semiconductor wafer. And according to the plating apparatus for wafer related to the invention, the whole area of a target plating surface of a wafer can be subjected to more uniform plating treatment and moreover a target plating surface of a wider area can be subjected to positive and uniform plating treatment.

What is claimed is:

1. A plating apparatus for a wafer which comprises:

a plating tank which houses a plating solution;

a holding member which positions a wafer to be plated with respect to the plating tank; and a bar-like stirrer provided within the plating tank, wherein said plating apparatus is capable of performing a plating treatment of a target plating surface of said wafer while stirring the placing solution near the target plating surface of the wafer by moving the stirrer, wherein said stirrer is capable of being rotated while being oscillated in a motion plane substantially parallel to the target plating surface of the wafer.

2. The plating apparatus for wafer according to claim 1, wherein the oscillation of said stirrer is a motion in which said stirrer repeatedly crosses a perpendicular line which is extended from a center position of the target plating surface in a direction orthogonal to the target plating surface.

3. The plating apparatus for wafer according to claim 1, wherein the plating apparatus for wafer further comprises a pedestal which rotates about an orthogonal axis substantially orthogonal to the target plating surface within the plating tank and a support of the stirrer which is installed on said pedestal, said support having a set of connecting members which constitute a quadric link mechanism along with the pedestal and the stirrer.

4. The plating apparatus for wafer according to claim 1, wherein the bar-like stirrer has a longitudinal size larger than a radius size of the plating tank.

5. The plating apparatus for wafer according to claim 1, wherein a drive mechanism which rotates the pedestal of the stirrer is a device which transmits a driving force from a power source to the pedestal via a magnet coupling.

6. The plating apparatus for wafer according to claim 1, wherein the holding member for a wafer is provided with a cathode used in electrolytic plating treatment, within the plating tank there are provided an anode used in electrolytic plating treatment and a diaphragm which partitions an interior of the plating tank into a cathode side on which the stirrer is installed and an anode side, and a second stirrer is installed in a region on the anode side of the interior of the plating tank partitioned by the diaphragm.

7. A plating apparatus for a wafer which comprises:

a plating tank which houses a plating solution;

a holding member which positions a wafer to be plated with respect to the plating tank; and a bar-like stirrer provided within the plating tank, said plating apparatus being capable of performing a plating treatment of a target plating surface of said wafer while stirring the plating solution near the target plating surface of the wafer by rotating the stirrer, wherein said stirrer rotates in a motion plane substantially parallel to the target plating surface of the wafer and makes a movement in such a manner that a locus of a position of rotational center of the stirrer is formed outside a locus of a center position of the stirrer and the stirrer repeatedly crosses a perpendicular line which is extended from a center position of the target plating surface in a direction orthogonal to the target plating surface.

8. A cup-type plating apparatus for a wafer which comprises:

(a) a plating tank capable of housing a plating solution;

(b) a wafer holding member disposed around an inner periphery of the plating tank, for holding a wafer to be plated around an inner periphery of the plating tank; and (c) a bar-shaped stirrer mounted within the plating tank, for stirring a plating solution housed within the plating tank, wherein the apparatus is capable of plating a target plating surface of a wafer while stirring a plating solution near the target plating surface by moving the stirrer, and wherein said stirrer is capable of being rotated on a vertical axis while being oscillated in a motion plane substantially parallel to the target plating surface of the wafer, wherein the stirrer is capable of oscillating in a motion such that the stirrer repeatedly crosses a perpendicular line which is extended from a center position of the target plating surface in a direction orthogonal to the target plating surface.

9. The plating apparatus of claim 8, further comprising:

(d) a pedestal attached to the stirrer and being mounted within the plating tank, which pedestal is capable of rotating about an orthogonal axis substantially orthogonal to the target plating surface of a wafer within the plating tank, wherein the pedestal comprises a pedestal body and a ring-shaped external gear on the outer periphery of the pedestal body;

(e) a drive mechanism mounted within the plating tank, which drive mechanism is capable of rotating the external gear of the pedestal via a motor, and wherein said drive mechanism comprises a driving shaft and a driving gear, which driving gear meshes with the external gear of the pedestal; and (f) a stirrer support, comprising a pair of connecting members, each comprising a gear and rotatably supported by a support shaft, wherein each connecting member is attached to a peripheral part of the pedestal body, and wherein each connecting member meshes with an annular internal gear provided on an inner side wall of the plating tank;

wherein the stirrer is attached to at least one connecting member, and wherein the stirrer, the pedestal, and the connecting members constitute a quadric link mechanism.

10. The plating apparatus of claim 9, wherein the bar-shaped stirrer has a longitudinal size larger than a radius size of the plating tank.

11. The plating apparatus of claim 10, wherein the driving shaft and driving gear of the driving mechanism arc connected together via a magnetic coupling.

12. The plating apparatus of claim 11, further comprising a diaphragm which partitions an interior of the plating tank into a cathode side wherein the stirrer is mounted, and an anode side wherein a second stirrer is mounted, wherein the wafer holding member is provided with a cathode for electrolytic plating; wherein an anode is provided within the plating tank, which anode is for electrolytic plating, and wherein a diaphragm is provided, which diaphragm partitions an interior of the plating tank into a cathode side wherein the stirrer is mounted, and an anode side wherein a second stirrer is mounted.

13. The plating apparatus of claim 10, further comprising a diaphragm which partitions an interior of the plating tank into a cathode side wherein the stirrer is mounted, and an anode side wherein a second stirrer is mounted, wherein the wafer holding member is provided with a cathode for electrolytic plating; wherein an anode is provided within the plating tank, which anode is for electrolytic plating, and wherein a diaphragm is provided, which diaphragm partitions an interior of the plating tank into a cathode side wherein the stirrer is mounted, and an anode side wherein a second stirrer is mounted.

14. The plating apparatus of claim 9, wherein the driving shaft and driving gear of the driving mechanism are connected together via a magnetic coupling.

15. The plating apparatus of claim 9, further comprising a diaphragm which partitions an interior of the plating tank into a cathode side wherein the stirrer is mounted, and an anode side wherein a second stirrer is mounted, wherein the wafer holding member is provided with a cathode for electrolytic plating; wherein an anode is provided within the plating tank, which anode is for electrolytic plating, and wherein a diaphragm is provided, which diaphragm partitions an interior of the plating tank into a cathode side wherein the stirrer is mounted, and an anode side wherein a second stirrer is mounted.

16. The plating apparatus of claim 8, wherein the bar-shaped stirrer has a longitudinal size larger than a radius size of the plating tank.

17. The plating apparatus of claim 8, wherein the driving shaft and driving gear of the driving mechanism are connected together via a magnetic coupling.

18. The plating apparatus of claim 8, further comprising a diaphragm which partitions an interior of the plating tank into a cathode side wherein the stirrer is mounted, and an anode side wherein a second stirrer is mounted, wherein the wafer holding member is provided with a cathode for electrolytic plating; wherein an anode is provided within the plating tank, which anode is for electrolytic plating, and wherein a diaphragm is provided, which diaphragm partitions an interior of the plating tank into a cathode side wherein the stirrer is mounted, and an anode side wherein a second stirrer is mounted.

19. The plating apparatus of claim 8 wherein the direction of rotation and/or oscillation of the bar-shaped stirrer is reversible.

20. A method for plating a wafer which comprises:

I. providing cup-type plating apparatus for a wafer which comprises:

(a) a plating tank housing a plating solution;

(b) a wafer holding member disposed around an inner periphery of the plating tank, for holding a wafer to be plated around an inner periphery of the plating tank; and (c) a bar-shaped stirrer mounted within the plating tank, for stirring a plating solution housed within the plating tank, which plating apparatus is capable of plating a target plating surface of a wafer while stirring a plating solution near the target plating surface by moving the stirrer, and wherein said stirrer is capable of being rotated on a vertical axis while being oscillated in a motion plane substantially parallel to the target plating surface of the wafer;

II. retaining a wafer on the wafer holding member;

III. plating a target plating surface of the wafer with the plating solution while stirring the plating solution near the target plating surface by moving the stirrer by rotating the stirrer on a vertical axis while the stirrer is being oscillated in a motion plane substantially parallel to the target plating surface of the wafer.

* * * * *